United States Patent [19]

Kirjavainen

[11] 4,202,724

[45] May 13, 1980

[54] QUICK CONNECT APPARATUS FOR HEADBOX COMPONENTS IN A PAPER MAKING MACHINE

[75] Inventor: Alvi Kirjavainen, Jyvaskyla, Finland

[73] Assignee: Valmet Oy, Finland

[21] Appl. No.: 16,147

[22] Filed: Feb. 28, 1979

[30] Foreign Application Priority Data

Mar. 2, 1978 [FI] Finland ..... 780711

[51] Int. Cl.[2] ..... D21F 1/02

[52] U.S. Cl. ..... 162/272; 162/336; 162/340

[58] Field of Search ..... 162/272, 336, 340, 343

[56] References Cited

U.S. PATENT DOCUMENTS

| | | | |
|---|---|---|---|
| 2,381,286 | 8/1945 | Hornbostel et al. | 162/336 X |
| 3,943,035 | 3/1976 | Stotz et al. | 162/272 |
| 4,063,997 | 12/1977 | Kirjavainen et al. | 162/340 |
| 4,089,739 | 5/1978 | Hildebrand et al. | 162/343 |

*Primary Examiner*—Richard V. Fisher

*Attorney, Agent, or Firm*—Steinberg & Blake

[57] ABSTRACT

Quick connect apparatus for headbox components in a paper making machine, e.g., apparatus to quickly connect and disconnect the equalizing chamber portion of the air cushion damper from associated distribution header and turbulence sections of the machine, include an elongate locking rod extending over a substantial portion of the end region of the components to be attached, the locking rod being mounted for longitudinal movement. The locking rod is provided with spaced locking portions adapted to lockingly engage correspondingly spaced portions of adjacent components to which said component is to be attached. The components are quickly connected in one embodiment by the longitudinal movement of the elongate locking rod or, in another embodiment, by the rotational movement thereof, whereby the locking portions on the rod are moved into and out of locking engagement with the corresponding spaced locking portions of the other component.

12 Claims, 10 Drawing Figures

QUICK CONNECT APPARATUS FOR HEADBOX COMPONENTS IN A PAPER MAKING MACHINE

BACKGROUND OF THE INVENTION

This invention relates generally to paper making machines and, more particularly, to quick connect apparatus for detachably locking a component of the headbox such, for example, as air cushion dampers, covers, bottom plates, or the like, in operative position while permitting the quick detachment thereof from the headbox to allow for cleaning or other servicing thereof.

Conventional headboxes presently in use in paper making machines may be divided into three distinct categories, namely, (1) headboxes provided with an air cushion device directly incorporated therewith or so-called air-cushion headboxes; (2) hydraulic headboxes provided with air cushion devices which are separate from the actual headbox and which are located either in the pulp stock approach pipe system upstream of the distribution header or downstream of the distribution header, and (3) hydraulic headboxes which are not equipped with such air cushion devices.

The object of providing the headbox of a paper making machine with an air cushion device is to equalize any pressure fluctuations which occur in the pulp stock flow upstream of the out flow aperture, or lip slice, of the headbox. Such pressure fluctuations are created either in the pulp stock flow system upstream of the headbox or in the course of flow of the pulp stock in the headbox itself. If these pressure fluctuations remain in the pulp stock as far as the lip slice headbox, velocity variations will occur in the rate of discharge of the stock therefrom, resulting in corresponding longitudinal variations in the base weight of the web which is subsequently formed on the forming wire of the paper machine. Since such base weight variations cannot be completely equalized during subsequent web drying steps, the same become visible in the finished paper which, of course, detracts from its value.

In order to at least partially overcome this problem, and to provide a uniform average pulp flow velocity profile, it is common practice to provide the inlet distribution pipes of the headbox, i.e., the inlet distribution header, with the shape of a truncated cone or the like in the direction transverse to the pulp stock flow, and, when desired, with a continuous by-pass flow provided at its ultimate end. A plurality of diffuser pipes extend from the conical distribution header in the longitudinal direction of pulp stock flow from which the pulp stock flows from the header into the headbox.

A serious problem exists in connection with the operation of conventional paper making machine headbox apparatus as described above. More particularly, fibers from the pulp stock tend to become caught in the flow passages of the headbox, thereby necessitating the periodic cleaning of the same at frequent intervals. These intervals depend on the particular running conditions as well as the quality of the pulp stock and vary within a very broad range. In order to allow the cleaning of headboxes in conventional paper making machines, and in particular in a machine which utilizes hydraulic headboxes, the pressure equalizing or air cushion portion located between the inlet distribution pipes or header and the turbulence section, is usually adapted to be displacable so that the distribution header and turbulence portion can be cleaned through the spaces vacated by the displaced portion, the pressure equalizing portion being easily cleaned at the same time. In such conventional headboxes, these components are generally joined at mating flanges by bolts. Thus, two joints defined by the pressure equalizing portion and the distribution header and turbulence sections are joined at respective mating flanges by bolts. For example, in a paper machine with a transverse working breath of about 8 meters, more than one hundred bolts are often used to accomplish the connection of the mating flanges. The areas in which the bolts are inserted are often extremely cramped and provide poor accessability. As a result, it is not uncommon for the detachment and reattachment of the pressure equalizing portion from the other headbox components to take between 1 and ½ and three hours, depending on the particular design of the machine. Of course, during this time, the paper machine is shut down thereby resulting in considerable losses in production.

SUMMARY OF THE INVENTION

Accordingly, one object of the present invention is to provide a new and improved quick connect apparatus for detachably locking a component of the headbox, such as the air cushion damping portion thereof, to associated other components of the headbox.

Another object of the present invention is to provide a new and improved quick connect apparatus as described above which enables the mounting and connection of the headbox component in a time which is a fraction of that normally required thereby reducing the losses in production time normally incurred in such operation.

Briefly, in accordance with the present invention, these and other objects are attained by providing a paper making machine with quick connect apparatus comprising an elongate locking rod which extends over a substantial portion of the transverse edge region of the component to be attached, the locking rod being mounted for movement by a hand wheel, pneumatic motor, or other means. The elongate locking rod is provided with spaced locking portions which are adapted to be in locking engagement with corresponding portions of the other components to which the component is to be secured. The quick connect apparatus is selectively opened and closed by movement of the locking rod through actuation of the moving means thereby moving the corresponding locking portions out of and into such locking engagement.

The use of the present invention allows for a reduction in time in which the component can be released from and reconnected to the other component to about ten minutes.

Apparatus is also provided for mechanically lifting the component to be attached from its operative position to allow for cleaning and other servicing of the headbox.

DESCRIPTION OF THE DRAWINGS

A more complete appreciation of the invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
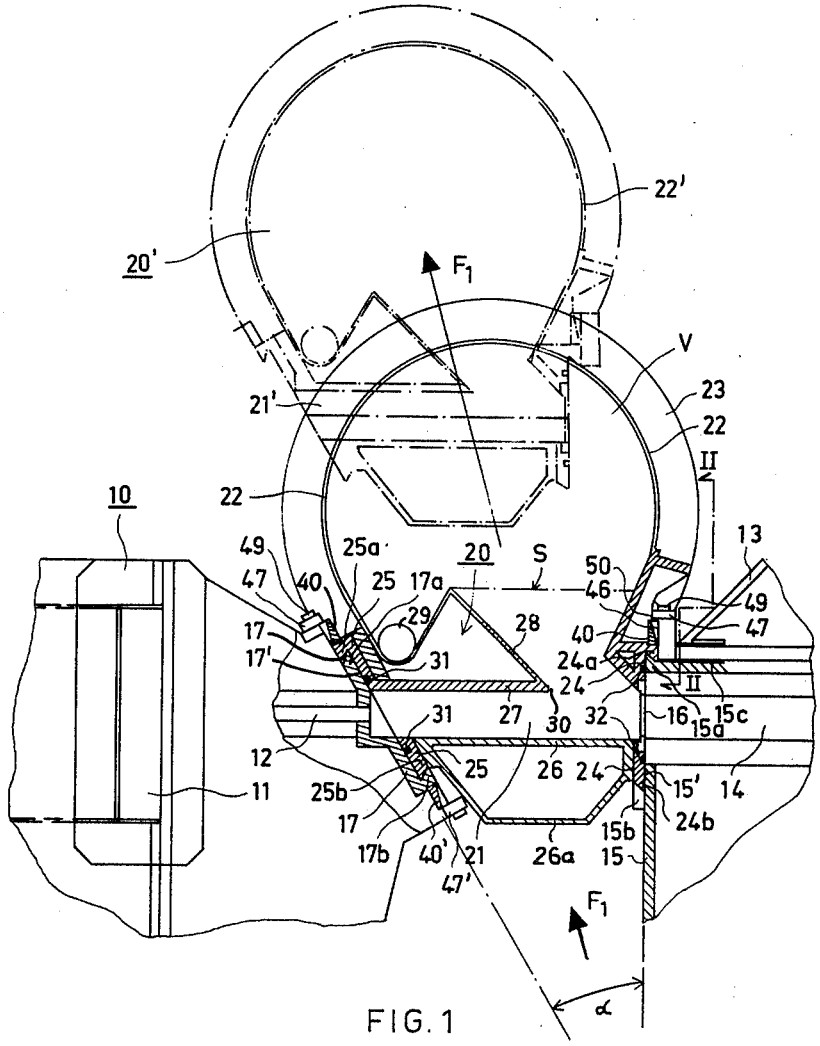
FIG. 1 is a side view in partial section illustrating the connection of the equalizing chamber portion to the distribution header and turbulence duct component of a paper making machine according to the present invention.

Referring now to the drawing wherein like reference characters designate identical or corresponding parts throughout the several views and, more particularly, to FIG. 1, a hydraulic headbox of a paper making machine is shown which includes components conventionally found in presently existing headboxes. The headbox includes a distribution header 10 comprising an inlet distribution pipe 11 having a tapering configuration in the direction transverse to the machine direction and a pipe system including a plurality of mutually adjacent distribution pipes 12 exiting from the inlet distribution pipe 11 in the machine direction, each distribution pipe 12 preferably having a circular cross-section. The downstream ends of distribution pipes 12 open into the equalizing chamber 21 of an equalizing chamber component 20 which includes a damping tank 22 confining an air volume V which serves as damping means, all of which is conventional and known in the art. A turbulence duct component 14 is located downstream of the equalizing chamber component 20 in the direction of pulp stock flow, the turbulence component 14 typically comprising a plurality of mutually spaced lamellae extending parallel to the direction of flow. The upper lip beam 13 of the headbox is located over the turbulence component 14 and a grating 16 is interposed between the equalizing chamber 21 and the turbulence component 14.

Referring to FIG. 1, the equalizing chamber 21 is defined by lower and upper walls 26, 27, respectively, the upper wall 27 forming an aperture 30 through which the pulp stock rises to a level indicated by the dot-dash line, designated S. The height of level S is defined by a weir wall 28 having an overflow channel at its upper region which communicates with the end of an overflow pipe 29. The air volume V is confined within a substantially cylindrical housing 22 having an outer reinforcing shell 23. The lower wall 26 of the equalizing chamber 21 comprises a part of a beam **26*a*** having an enclosed box-shaped cross section.

The system of distribution pipes 12 includes a planar coupling beam or flange 17 mounted at their downstream ends which extend in a direction transverse to the direction of pulp stock flow while the turbulence component 14 includes a planar coupling beam or flange 15 mounted at its upstream end. According to the present invention, the equalizing chamber component 20 is detachably affixed in its operative position between the planar beams 15, 17 by quick connect apparatus as described below. The respective planes defined by beams 15, 17 intersect each other at an angle $\alpha$ which angle encompasses the direction, designated $F_1$, in which the equalizing chamber component 20, is detached from the associated distribution header and turbulence component.

As mentioned hereinabove, it is an important object of the present invention to minimize the time required to detach and remove a component of the headbox in order to clean the latter and the time required for subsequent reattachment of the component to the headbox. Thus, according to the present invention, quick connect apparatus is provided by which the equalizing chamber component 20 can be quickly detachably locked in its operative position to the associated distribution pipe system 12 and turbulence component 14 in a manner such that it can be rapidly unlocked and removed from its operative position so that the headbox can be cleaned and so that a rapid reattachment of the equalizing chamber to these components can be accomplished as well.

Referring to FIG. 1, to this end, the coupling beam or flange 15 of the turbulence component 14 has a transversely extending supporting beam portion **15*b* affixed to its inwardly facing surface, the beam portion 15*b* defining with the inwardly facing surface of flange 15, a wedge-shaped groove. In a similar manner, the coupling beam or flange 17 of the distribution pipe system 12 has an inwardly projecting portion 17*b* integrally formed at its lower edge region defining a wedge-shaped downwardly tapering groove while the upper end 17*a* of the beam 17 is formed having a wedge-shaped portion. The upper wall 15*c* of the turbulence component 14 has a wedge-shaped portion 15*a* disposed in the plane of coupling beam 15**.

The equalizing chamber 21 of equalizing chamber component 20 is provided with upstream and downstream connecting walls 25, 24 respectively, adapted to cooperate with coupling beams 17, 15. More particularly, a beveled portion **25*b* is provided upon the upstream end of lower wall 26 adapted to engage the lower projecting portion 17*b* of coupling beam 17, and, in a similar manner, a projecting portion 25*a* is provided in the upper part of wall 25 adapted to engage the upper edge 17*a* of coupling beam 17. Furthermore, the downstream wall 24 of equalizing chamber 21 is provided with upper and lower portions 24*a, b* which are wedge-shaped and which are adapted to engage with the corresponding grooves formed by the wedge-shaped portion 15*a* and the supporting beam portion 15*b* of coupling beam 15. As is readily apparent, upstream and downstream joints 17', 15' are defined by the engagement of upstream and downstream connecting walls 25, 24 of equalizing chamber 21 with the coupling beams 17, 15 of the distribution pipe system 12 and turbulence component 14. The joints 17', 15' are in tight, fluid-sealing engagement by virtue of the weight of the equalizing chamber component 20 which tends to fixedly locate the latter in the downwardly tapering space subtended by the angle $\alpha$ defined between the distribution pipe system 12 and turbulence component 14. Elastic sealing members 31, 32 are preferably provided in recesses formed in the connecting walls 25, 24** respectively.

According to the present invention, in order to accomplish the quick detachable connection of the equalizing chamber component 20 to the headbox component as described above, quick connect apparatus are provided in operative association with the upper and lower transversely extending edges of the upstream connecting wall 25 of the equalizing chamber 21 and with the upper edge of the downstream connecting wall 24 of the equalizing chamber 21. Thus, referring to FIGS. 1–3, the quick connect apparatus includes an elongated locking rod 40 which engages at one end thereof a threaded shaft 41 (FIG. 2) which threadedly engages a sleeve 43 which is rotatably mounted within a sleeve 44 fixed to a frame flange 53. A handwheel 45 is fixed to sleeve 43. Thus, through rotation of hand wheel 45, the threaded shaft 41 is longitudinally moved thereby longitudinally moving the elongated locking rod 40 in the direction of arrow $F_2$ in FIG. 2. The upper locking rods 40, i.e. the locking rods operatively associated with the upper edges of connecting walls 25, 24 of equalizing chamber 21, are mounted on the equalizing chamber component 20 for longitudinal movement with respect thereto by guide braces 51 (FIGS. 2 and 3) which are fixed by screws 54 to the respective upstream and downstream walls 24, 25 of equalizing chamber component 20. The lower locking rod 40' (FIG. 1) operatively associated with the lower edge of connecting wall 25 is similarly mounted for longitudinal movement by appropriate guide braces which, unlike the braces which mount the upper locking rods, are fixed to coupling beam 17 of the distribution pipe system 12.

Each locking rod 40 has a rectangular cross-section and has a plurality of equally spaced locking portions provided thereon. In the embodiment illustrated in FIGS. 1–3, the locking portions are provided with a plurality of mutually equally spaced slots 46 which are slant-bottomed and which open onto at least two surfaces of the rod 40.

Figure 2:
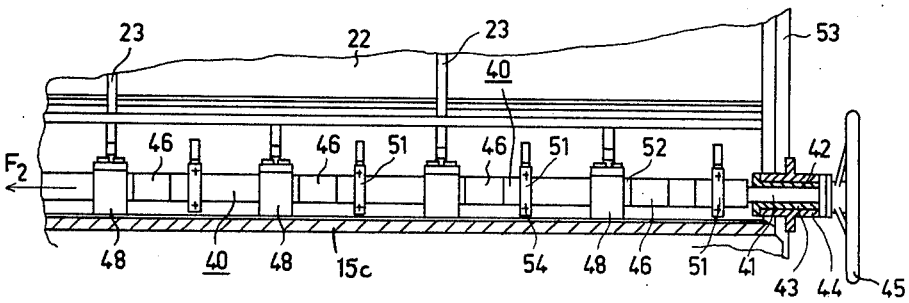
FIG. 2 is a section view taken along line II—II of FIG. 1.
Figure 3:
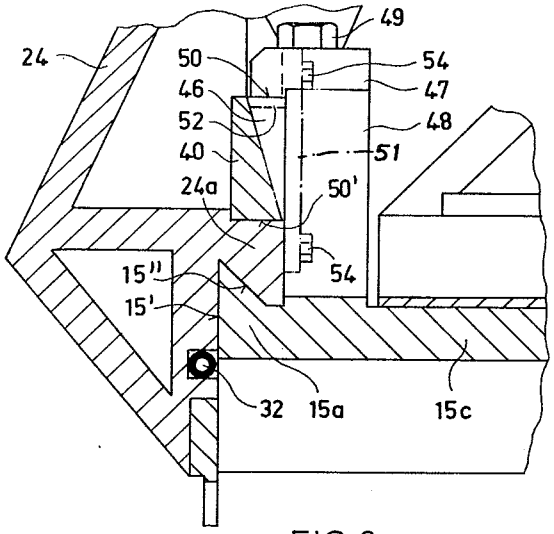
FIG. 3 is an enlarged side section view illustrating the details of the quick connect apparatus of the present invention at the point of connection between the equalizing chamber portion and the turbulence component of the headbox.

A corresponding plurality of spaced locking tongues 47 are provided for each of the locking rods 40. In the case of the upper locking rods 40, the corresponding locking tongues 47 are fixed to the coupling beams 15, 17 of the distribution pipe system and turbulence component while in the case of the lower locking rod 40' the locking tongues 47' (FIG. 1) are fixed to the equalizing chamber component 20. For example, referring to FIG. 3, the locking tongues 47 are affixed by screws 49 to a projecting piece 48, the latter being affixed to the upper wall 15*c* of the turbulence component 14 by welding or the like. Each locking tongue 47,47' includes a mating surface 50 which abut against the upper side of a respective locking rod 40 when the equalizing chamber component 20 is locked in its operative position as best seen in FIG. 2. The locking tongues 47, 47' are mutually spaced with the same spacing as the slots 46 which are formed in the respective locking rod with which the locking tongues are associated. The locking rods 40 are preferably formed of bronze which has a favorable friction characteristic when paired with locking tongues preferably formed of steel.

Figure 4:
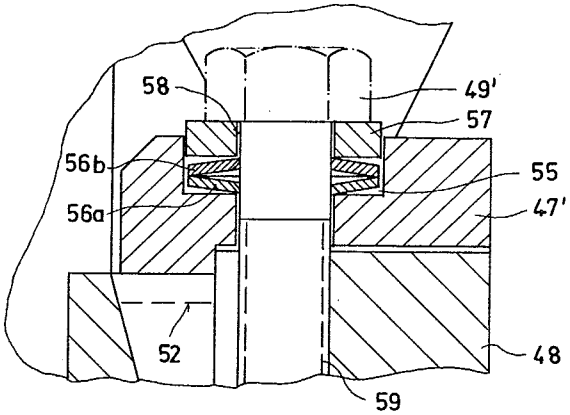
FIG. 4 is a detail view in partial section of one embodiment of the quick connect apparatus of the present invention.

The locking tongues 47' are preferably mounted so as to have some "give" to allow for machining tolerances or minor deformations which might exist in the locking rods 40. Thus, referring to FIG. 4, the locking tongue 47' is affixed by a screw 49' to a projecting piece 48, the screw 49' having a threaded shaft 59 and a smooth cylindrical shank portion 58. An elastic attachment of the screw 49' is accomplished through the provision of a pair of opposed spring washers 56*a*, 56*b* and an overlying washer 57 around the smooth shank portion 58, the washer 57 being received in a recess 55 formed in the locking tongue 47'. In this manner, the locking tongues have at least some elastic "give" to compensate for any misalignments in the locking rods.

In operation, when the equalizing chamber component 20 is locked in operative position, i.e., when the locking means are in their locked configuration, the mating surfaces 50 of the locking tongues abut against the upper surface of the locking rod 40. Of course, in this configuration, the slots 46 formed in the locking rods are located between the locking tongues 47'. When it is desired to unlock the equalizing chamber component from the distribution pipe system and turbulence components so that the chamber component can be detached therefrom, the respective locking rods 40 are longitudinally indexed by rotation of handwheel 45 (or by other conventional means) until the slots 46 register and align with the locking tongues 47 whereupon the equalizing chamber component can be lifted from its operating position as shown by the phantom illustration in FIG. 1. As seen in FIG. 1, the direction in which the chamber component 20 is lifted is indicated by the arrow $F_1$ which substantially bisects the angle $\alpha$ defined by the intersection of the planar beams 15, 17. The slots 46 are appropriately formed so that the angle defined by the slanting wall of each slot allows for each respective locking tongue to pass through the slot upon lifting of the chamber component 20. It will be seen that the upper locking rods 40 will remain associated with the equalizing chamber component 20 as the same as lifted away from the associated headbox components, locking rods 40 being continuously supported by guides 51, while the lower locking rod 40' remains associated with the coupling beam 17 of the distribution pipe system 12. The upper locking tongues 47 remain with the distribution pipes system and turbulence components while the locking tongues 47' remain associated with the equalizing chamber component 20.

After the equalizing chamber component 20 has been detached and removed as described above, access to the headbox is provided through the space which has been vacated. In this manner, both the distribution pipe system 12 and the turbulence component 14 may be cleaned or otherwise serviced. Upon completion of such servicing, the chamber component 20 is lowered back into its operative position whereupon the handwheels 45 or other conventional apparatus are operated. Each of the slots 46 are further defined by transversely obliquely extending surfaces 52 provided on one of their sides so that the locking rod will be reliably guided under the locking tongues as the rod is longitudinally moved. In this manner, a tight clamping relationship between the locking rod and tongues is assured. The elastic mounting of the locking tongues 47' described in connection with FIG. 4 further provides that the clamping pressure exerted by the mating surfaces 50 of tongues 47, 47' on locking rods 40, 40' is substantially the same at all points regardless of any machining errors of deformities in the locking rod 40.

Figure 5:
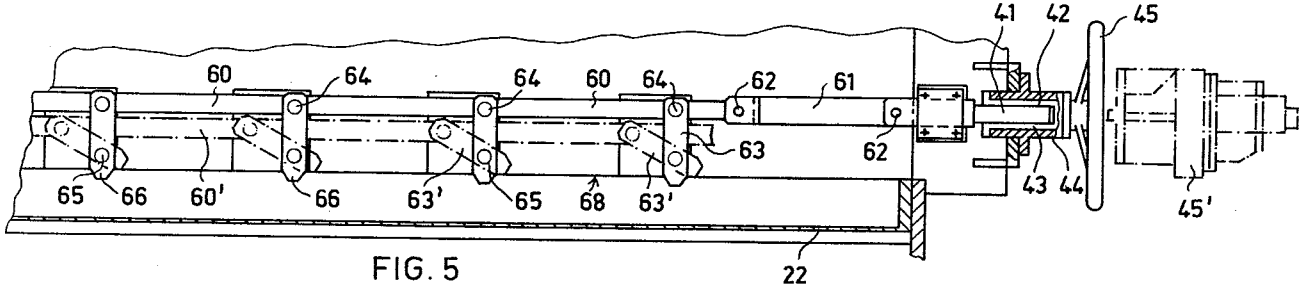
FIG. 5 is a view similar to FIG. 2 illustrating another embodiment of the quick connect apparatus of the present invention, FIG. 5 being a sectional view taken along line V—V of FIG. 6.
Figure 6:
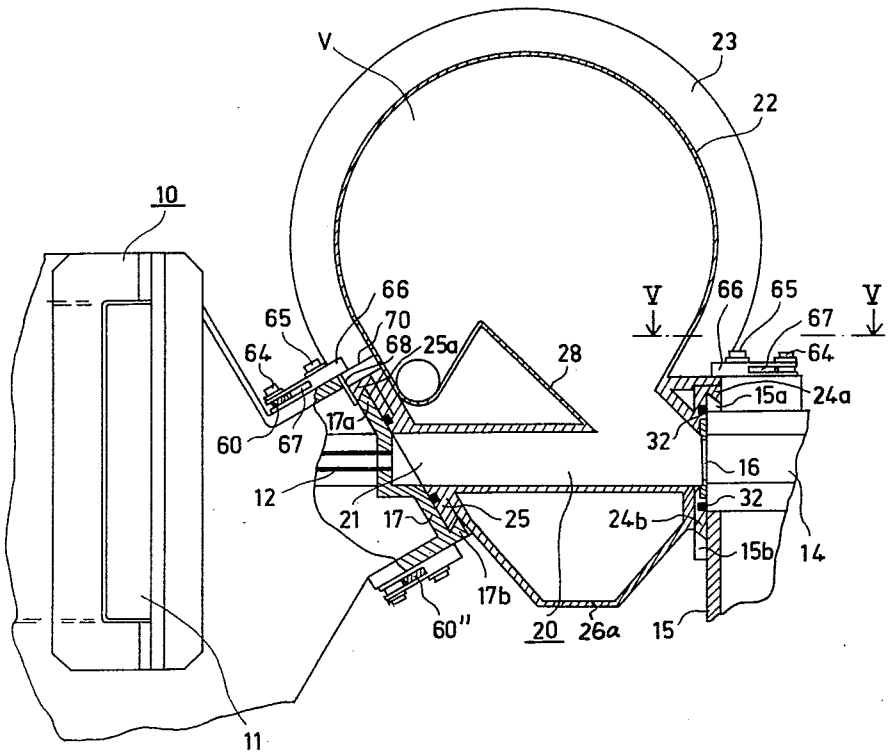
FIG. 6 is a view similar to FIG. 1 illustrating the embodiment of the quick connect apparatus of the present invention shown in FIG. 5.

Referring now to FIGS. 5 and 6, wherein another embodiment of the quick connect apparatus according to the present invention is illustrated the elements 41–45 thereof are essentially the same as the corresponding elements described above in connection with FIGS. 1–3. As shown in FIG. 5, a locking rod 60 is pivotally attached to an arm 61 through a pin 62, arm 61 being pivotally attached to screw 41 through another pin 62. A plurality of spaced locking portions in the form of locking arms 63 are each pivotally attached at one end to locking rod 60 through a pin 64. The locking arms 63 are pivotally mounted at their other end through hinge pin 65 to stationary frame portions. As seen in FIG. 6, each locking arm 63 has a bifurcated end defining a slit 67 through which the locking rod 60 passes to facilitate the pivotal connection thereto as described above. Each of the plurality of locking arms 63 has a locking tongue 66 defined by the end portions of the locking arms 63. As seen in FIG. 6, when the apparatus is in its locked configuration, each locking tongue 66 is located behind a mating surface 70 formed on the equalizing chamber portion 20 thereby securing the latter in place. In operation, rotation of the hand wheel 45 or actuation of other conventional means, such as the pneumatic motor 45', illustrated in phantom in FIG. 5, causes the rod 60 to shift longitudinally to the position 60' shown in phantom in FIG. 5 thereby turning the locking arms into the position 63', also shown in phantom. As the locking arms 63 turn, the locking tongues withdraw from engagement with mating surfaces 70 of equalizing chamber component 20 behind the threshold surface 68 thereof thereby unlocking the component. In other respects, the operation of the embodiment of the invention illustrated in FIGS. 5 and 6 is the same as that described in connection with FIGS. 1–4.

Figure 7:
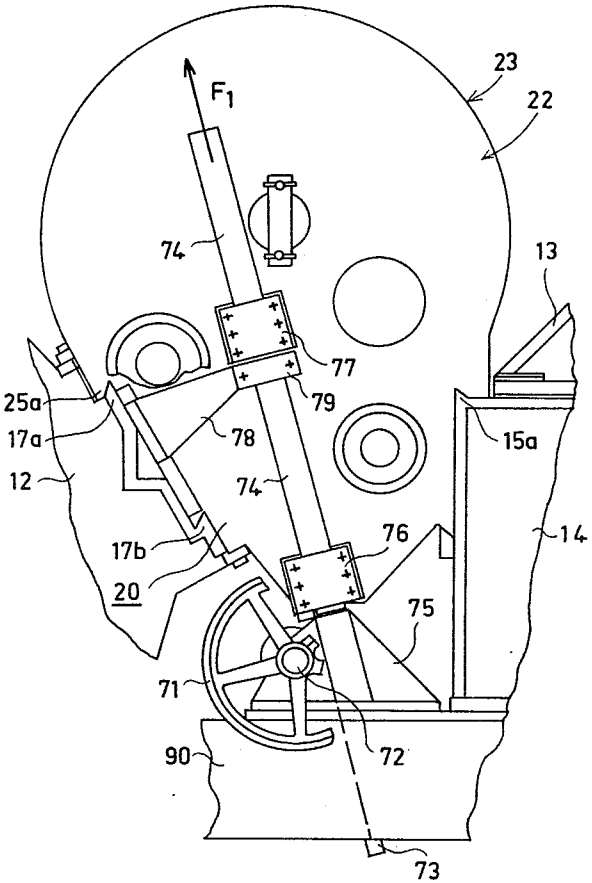
FIG. 7 is an end view illustrating lifting apparatus for use in connection with the present invention.
Figure 8:
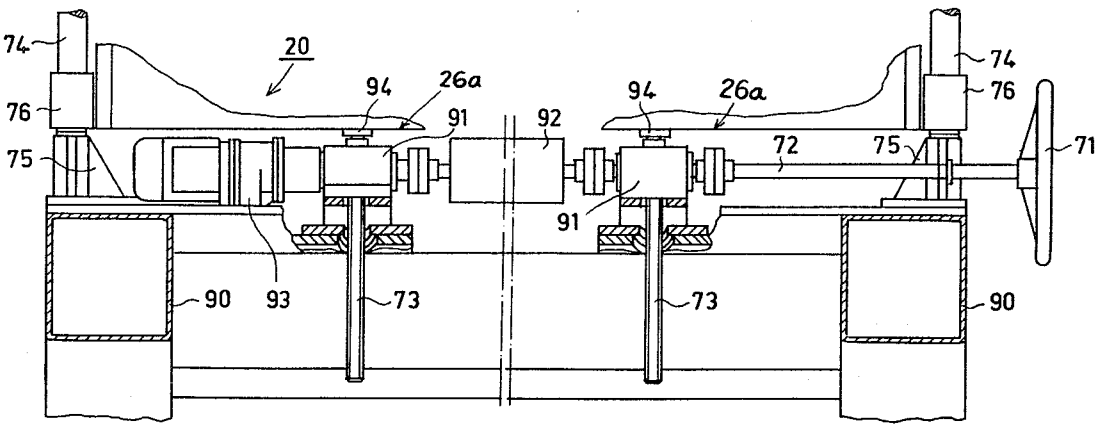
FIG. 8 is a front view in partial section of the lifting apparatus of the present invention.

FIGS. 7 and 8 illustrate apparatus for mechanically lifting or raising the equalizing chamber component 20 to the position illustrated in phantom in FIG. 1 as 20'. The lifting apparatus includes a rotatable shaft 72 extending across the machine in the transverse direction below the equalizing chamber component 20 to one end of which a hand wheel 71 is fixed. Shaft 72 is connected to a motor 93 through a power transmission shaft 92 which operates a pair of worm gear transmissions 91. As will be seen, the motor 93, which is controlled by limit switches, effects the lifting of the chamber component 20 and the majority of its lowering, the last phase of the lowering being effective by means of hand wheel 71. A vertically extending worm screw 73 is operably associated with each of the worm gear transmissions 91 in a manner such that the two worm screws 73 extend side by side, symmetrically, on either side of the central plane of the machine. The upper end of each of the worm screws 73 are fixed at a point 94 to the lower surface of the box-shaped beam 26*a* of the equalizing chamber component 20. The frame of the turbulence component 14 of the headbox supports projecting means 90, each of which has attached thereto an elongate guide member 74 through a respective flange 75. The guide members extend in a direction which is parallel to the lifting direction $F_1$ of the equalizing chamber portion 20. A pair of guides 76, 77 are fixed to each side of the equalizing chamber portion 20 through which the guide member 74 is adapted to slide. A beam 78 integrally extends from each side of the distribution pipe system 12 which carries on its end a guide 79 which encircles each respective guide member 74. In operation, after the quick connect apparatus has been unlocked thereby freeing equalizing chamber component 20, the motor 93 is activated causing the worm screws 73 to rise thereby lifting the chamber component 20, guide member 74 sliding within guide 76, 77. The chamber component is lowered in a similar manner, except that in the final stage of lowering of the component 20, the worm screws are moved through rotation of shaft 72 by hand wheel 71 so that a precise movement is obtained.

Figure 10:
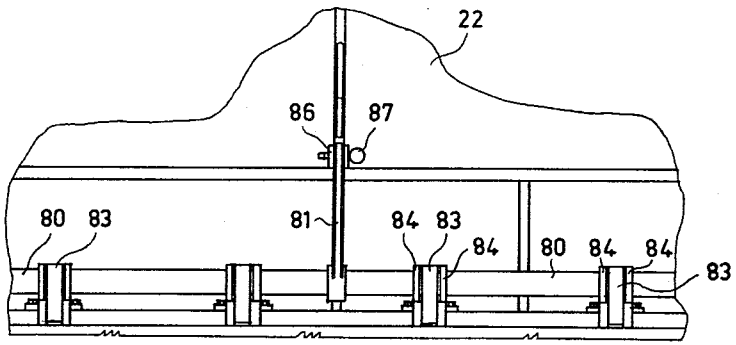
FIG. 10 is a front view of the embodiment of the quick connect apparatus of the present invention illustrated in FIG. 9.
Figure 9:
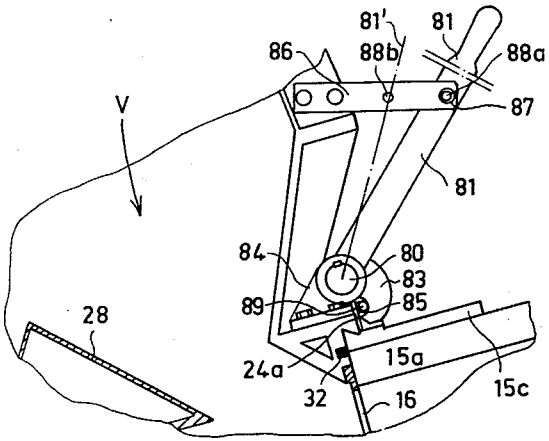
FIG. 9 is a detail side view of another embodiment of the quick connect apparatus of the present invention.

Referring now to FIGS. 9 and 10, another embodiment of the quick connect apparatus according to the present invention is illustrated. More particularly, an elongated locking rod is rotatably mounted on the equalizing chamber portion 20 by means of supports 84. Locking portions in the form of a plurality of locking tongues 83 spaced equidistantly from each other are attached to locking rod 80, each locking tongue 83 defining a locking slot 85. An elongate handle 81 is centrally fixed at one end to elongate rod 80, the handle 81 being movable between a pair of guides 86, also fixed to the equalizing chamber portion 20. Two pairs of aligned holes 88*a*, 88*b* are provided in the guides 86. A plurality of locking pins 89 are fixed to the coupling beam 15*c* of the turbulence component 14 (as well as to the distribution pipe system) by appropriate flanges adjacent to each of the locking tongues 83.

In operation, when the handle 81 is secured by a pin 87 in the locking holes 88*a* as illustrated in FIG. 9, the locking rod 80 will be in the position wherein the slot 85 of each locking tongue 83 captures a respective one of the locking pins 89 to lock the chamber component in place. Upon shifting the handle 81 to the position designated 81' shown in phantom in FIG. 9, wherein it may be secured by a pin 87 passing through holes 88*b*, the locking rod 80 is rotated so that the slots 85 of locking tongues 83 will release the pins 89 to thereby unlock the chamber component 20.

Obviously, numerous modifications and variations of the present invention are possible in the light of the above teachings. Accordingly, it is therefore to be understood that within the scope of the appended claims the invention may be practiced otherwise than as specifically described above.

What is claimed is:

1. In a paper making machine, quick connect apparatus for detachably locking a component of the headbox, such as the air cushion damping device, the distribution header, cover, and/or bottom plate, into its operative position and for unlocking the same to permit detachment thereof so that the headbox may be serviced, said component to be locked having forward and rearward edge regions in the direction of pulp stock flow adapted to matingly engage with corresponding edge regions of other components to define respective joints therewith, comprising:

an elongated locking rod extending over the substantial length of at least one of the edge regions of said component to be detachably locked in position;

a plurality of spaced locking portions provided on said elongated locking rod adapted to lockingly engage at least one other component of said headbox at its respective joint; and means for moving said elongated locking rod, said locking rod being movable such that said locking portions are movable out of said locking engagement with said other component to unlock the same by actuation of said moving means.

2. Apparatus as recited in claim 1 wherein said moving means includes a handwheel.

3. Apparatus as recited in claim 1 wherein said moving means includes a pneumatic motor.

4. Apparatus as recited in claim 1 wherein said component to be detachably locked comprises the equalizing chamber portion of the headbox, said chamber being adapted to be locked between the distribution header and the turbulence section of the headbox.

5. Apparatus as recited in claim 1 further including means for moving the component to be detachably locked out of its operative position upon unlocking the quick connect apparatus whereby upon unlocking the quick connect apparatus, said component is alternately movable between a first operative position and a second position such that the headbox can be serviced.

6. Apparatus as recited in claim 5 wherein said component comprises the equalizing chamber portion of the headbox and said moving means comprises means for lifting said equalizing chamber portion, said lifting means being located beneath said equalizing chamber portion.

7. Apparatus as recited in claim 4 wherein said forward and rearward edge regions of said equalizing chamber portion have attachment flanges formed thereon, said forward and rearward attachment flanges being adapted for attachment to corresponding edge regions of said turbulence section and said distribution header, the planes defined by said forward and rearward attachment flanges intersecting at an angle such that the direction in which said equalizing chamber portion is removable lies within said angle.

8. Apparatus as recited in claim 1 wherein said elongated locking rod has a substantially rectangular cross-section including a mating surface, said locking portions comprising a plurality of spaced slots being formed therein, each slot opening into said mating surface and at least one other surface; and further including a plurality of locking tongues fixed to said other component, said tongues being mutually spaced with the same spacing as said slots, said locking tongues also including a mating surface whereby in said locked position, said mating surfaces of said locking tongues are contiguous with the mating surface of said elongated rod, the latter being longitudinally movable to align said slots with said locking tongues to unlock said quick connect apparatus.

9. Apparatus as recited in claim 8 further including means for connecting said locking tongues to a projecting portion of said other component of said headbox in a resilient manner.

10. Apparatus as recited in claim 8 wherein each said slot is further defined by a surface extending obliquely with respect to said mating surface of said locking tongue to facilitate the locking of said component to said other components to which it is operatively connected with a wedge action so that it is clamped tightly thereagainst.

11. Apparatus as recited in claim 1 wherein said locking portions of said locking rod comprise a plurality of spaced locking arms pivotally attached to said locking rod, said arms also being pivotally attached to said other component, said locking arms having end portions defining locking tongues whereby upon longitudinal movement of said elongate rod, said locking tongues are alternately movable between locking and unlocking positions.

12. Apparatus as recited in claim 1 wherein said elongated rod is rotatable about its longitudinal axis; said locking portions comprising mutually spaced locking tongues, each of which defines a locking slot; and a plurality of locking pins provided on said other component adapted to be locked in the locking slots of said tongues.

* * * * *